US005080370A

United States Patent [19]

Lu

[11] Patent Number: 5,080,370

[45] Date of Patent: Jan. 14, 1992

[54] BLOCK GAME FOR CHILDREN

[76] Inventor: Feng-Chi Lu, P.O. Box 82-144, Taipei, Taiwan

[21] Appl. No.: 706,153

[22] Filed: May 28, 1991

[51] Int. Cl.[5] ..... A63F 3/02

[52] U.S. Cl. ..... 273/260

[58] Field of Search ..... 273/260, 287, 269, 148 R, 273/148 A; 446/85, 117; 434/208, 403

[56] References Cited

U.S. PATENT DOCUMENTS

| | | | |
|---|---|---|---|
| 717,105 | 12/1902 | Mansfield | 434/403 |
| 4,150,828 | 4/1979 | Marchese | 273/260 |
| 4,984,808 | 1/1991 | Young | 273/260 X |
| 5,028,048 | 7/1991 | Watson et al. | 273/269 X |
| 5,037,106 | 8/1991 | Jodway | 273/269 X |

FOREIGN PATENT DOCUMENTS

| | | | |
|---|---|---|---|
| 1163871 | 6/1985 | U.S.S.R. | 273/260 |

*Primary Examiner*—Edward M. Coven
*Assistant Examiner*—William E. Stoll
*Attorney, Agent, or Firm*—Alfred Lei

[57] ABSTRACT

A block game for children and in particular one which includes a case having a cover and a container divided into a major chamber and a minor chamber, a plurality of blocks disposed in the major chamber of the case, a tray adapted to be received in the major chamber of the case and a flap adapted to cover the minor chamber of the case, a pencil placed in the minor chamber of the case, a crayon put in the minor chamber of the case, an exercising book disposed on the upper surface of the tray, and a chess board put on the cover of the case.

1 Claim, 8 Drawing Sheets

BLOCK GAME FOR CHILDREN

BACKGROUND OF THE INVENTION

Archaeological research has revealed numerous playthings from prehistoric civilizations. Early Egyptian, Greek, and Roman dolls, tops, balls, rattles, hoops, and miniature representations of furniture, houses, and dishes have been preserved. Toys mady by individual craftsmen were early distributed in Germany; they were first sold chiefly peddlers at fairs. Although many new toys are created each year, some, especially dolls, balls art materials, and blocks, retain their popularity year after year. However, most toys on the present market can be played with a game only and so it is necessary to buy a number of toys in order to play different games.

Therefore, it is an object of the present invention to provide a block game for childern which may obviate and mitigate the above-mentioned drawbacks.

SUMMARY OF THE INVENTION

This invention relates to a block game for children.

It is the primary object of the present invention to provide a block game for children which may be used to play puzzle game.

It is another object of the present invention to provide a block game for children which may be used to practice mathematics.

It is still another object of the present invention to provide a block game for children which may be used to practice spelling.

It is still another object of the present invention to provide a block game for children which may be used to play chess.

It is a further object of the present invention to provide a block game for children which has an exercising book.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
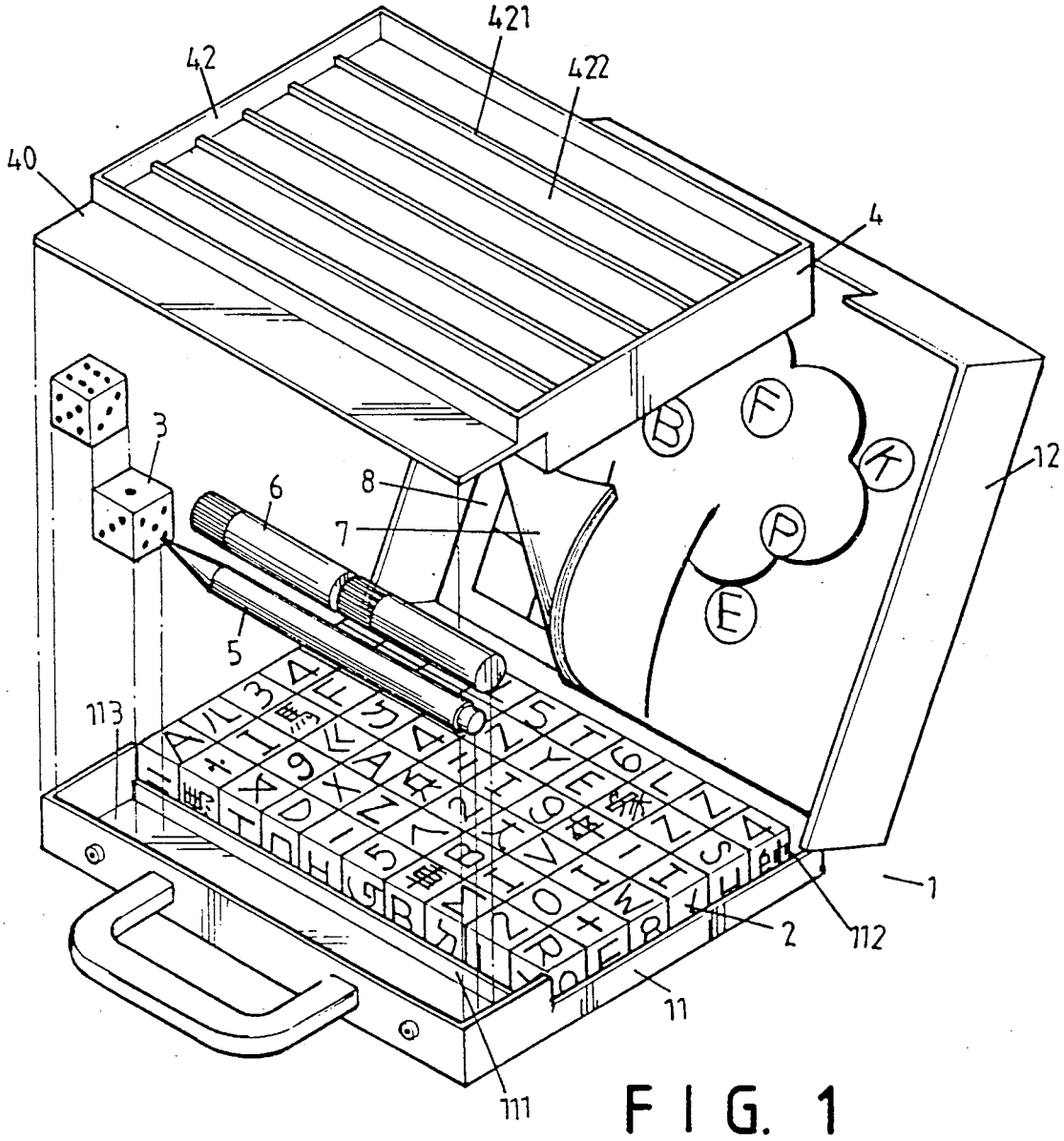
FIG. 1 shows an exploded view of the invention.
Figure 2:
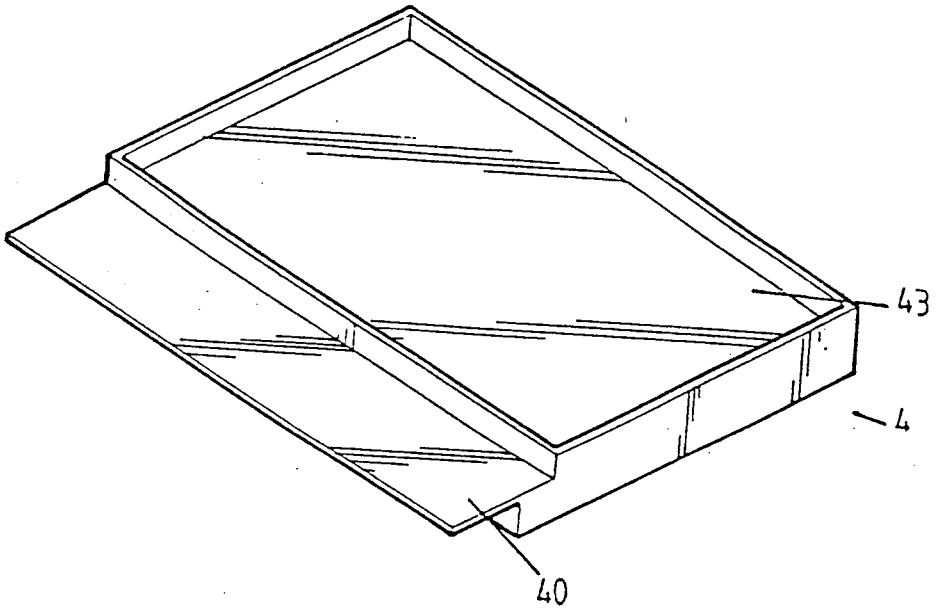
FIG. 2 shows the tray of FIG. 1.

With reference to the drawings and in particular to FIGS. 1 and 2 thereof, the present invention mainly comprises a case 1, sixty blocks 2, two dice 3, a tray 4, a pencil 5 (or ball point pen), a crayon 6, an exercising book 7 and a paper chess board 8.

The case 1 includes a container 11 and a cover 12 in which the container 11 is divided into the major chamber 112 and a minor chamber 113 by a partition 111.

The sixty blocks 2 are disposed :n the major chamber 112 of the case 1 while the two dice 3 are located in the minor chamber 113 of the case 1.

The tray 4 is designed to be received in the major chamber 112 of the case 1 and has a flap 40 adapted to cover the minor chamber 113 of the case 1. Further, the tray 4 is divided into a plurality of parallel grooves 422 by partitions 421 in its upper surface 42 and has a flat surface 43 at its bottom.

The pencil 5 (or ball point pen) and the crayon 6 are placed in the minor chamber 113 of the case 1 so that the childern may write or paint on the exercising book 7.

The exercising book 7 is used for the childern to practice writing English letters and Arabic numerals, calculating, and painting. In association with the blocks 2, the childern may get fun from learning.

The chess board 8 may be one for a particular game such as Chinese chess, Western chess or the like and is made of paper.

Figure 3A:
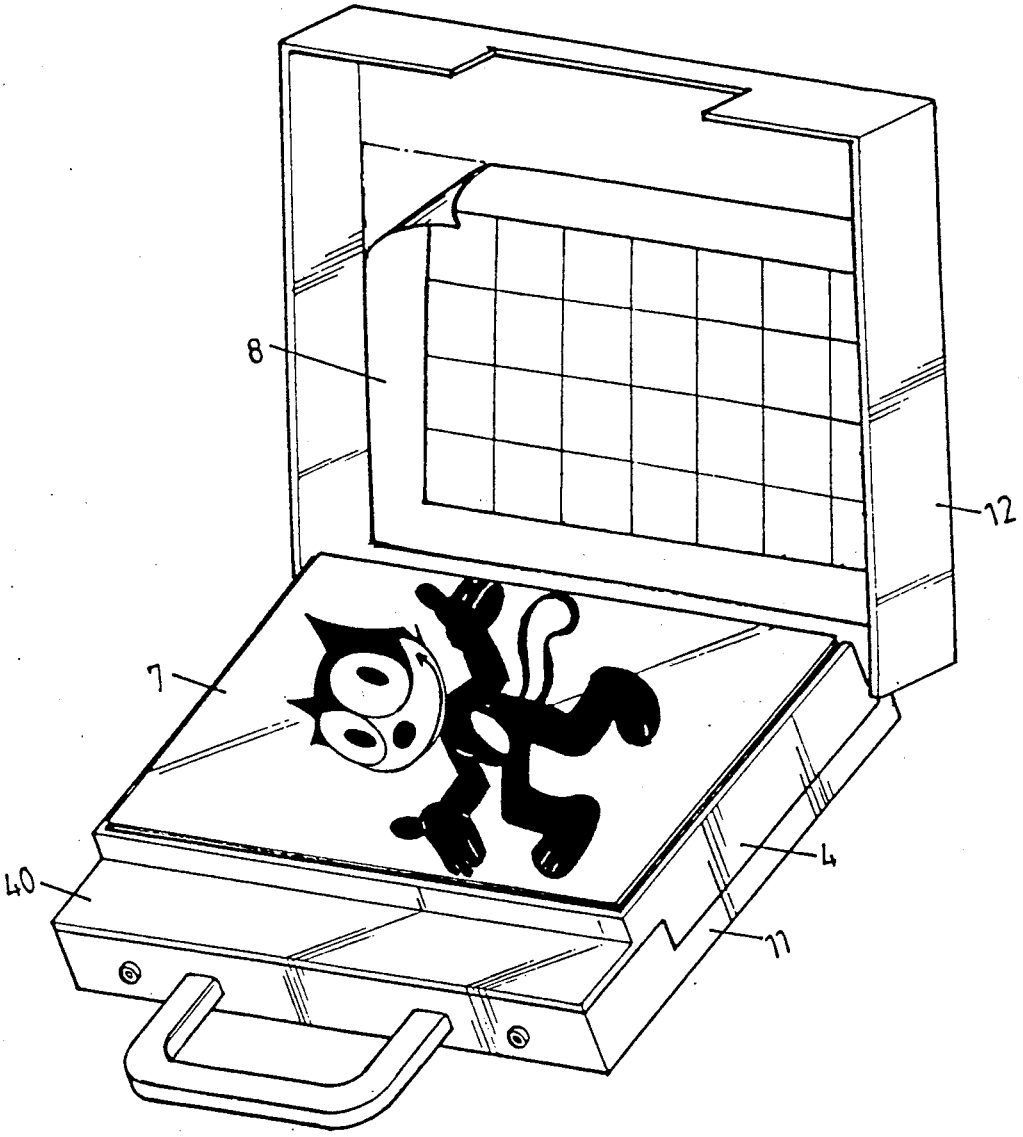
FIG. 3A shows another view of the invention with the tray in place.
Figure 3B:
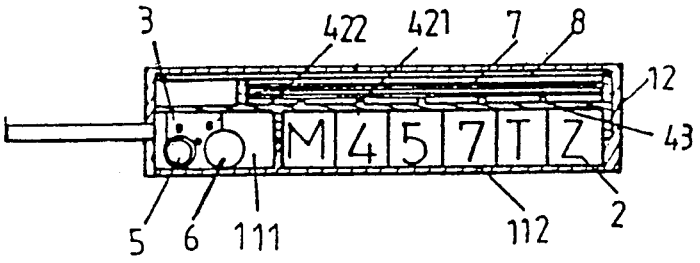
FIG. 3B and 3C show cross-sectional views of the invention.
Figure 3C:
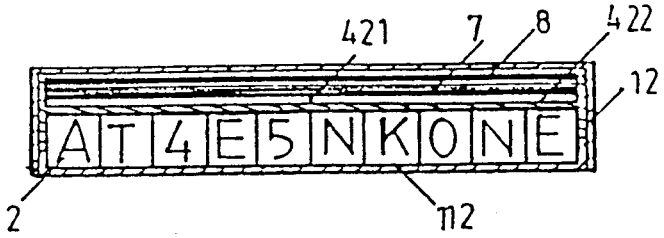

In assembly (see FIGS. 3A, 3B and 3C), dispose the sixty blocks 2 in the major chamber 112 of the case 1, place the two dice 3 in the minor chamber 113 of the case 1, and put the pencil (or ball point pen) and the crayon 6 in the remaining space of the minor chamber 113 of the case. Then put the tray 4 on the major chamber 112 of the case 1 with its flat surface 43 covering the sixty blocks 2 and its flap 40 covering the two dice 3, the pencil 5 (ball point pen) and the crayon 6. Thereafter, the chess board 8 and the exercising book 7 are disposed on the upper surface 42 of the tray 4.

Figure 4:
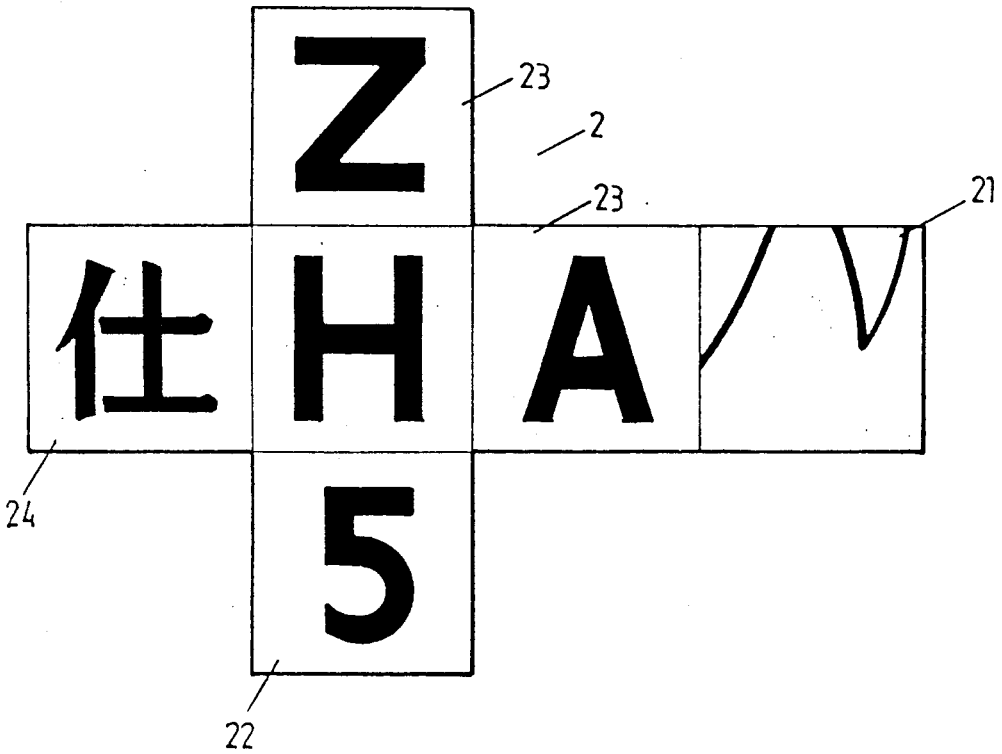
FIG. 4 shows the six surfaces of a block of the invention.

Referring to FIG. 4, the block 2 has six surfaces with different patterns, i.e. puzzle patterns 21, numerals 22 (such as arabic numeral, +, −, ×, ÷, (), ?. . . etc.), English letter 23 (or other language such as Japanese, Korean . . . etc.) and chessman 24.

Figure 5:
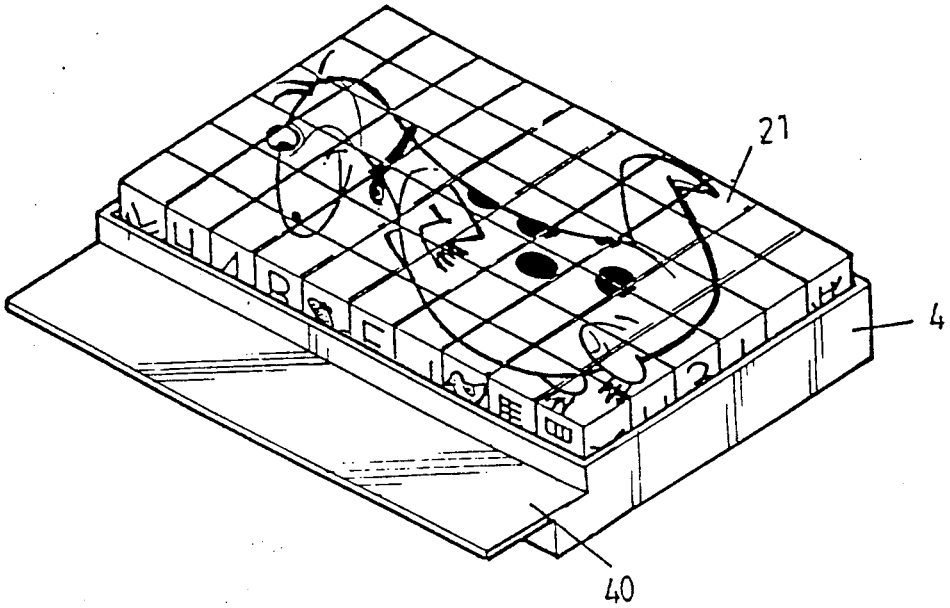
FIGS. 5, 6, 7A and 7B show the tray in use with the blocks.

The present invention may be played as follows:

1. Puzzle:

As shown in FIG. 5, the puzzle surfaces 21 of the blocks 2 may be re-arranged on the flat surface 43 of the tray 4 to form a design.

Figure 6:
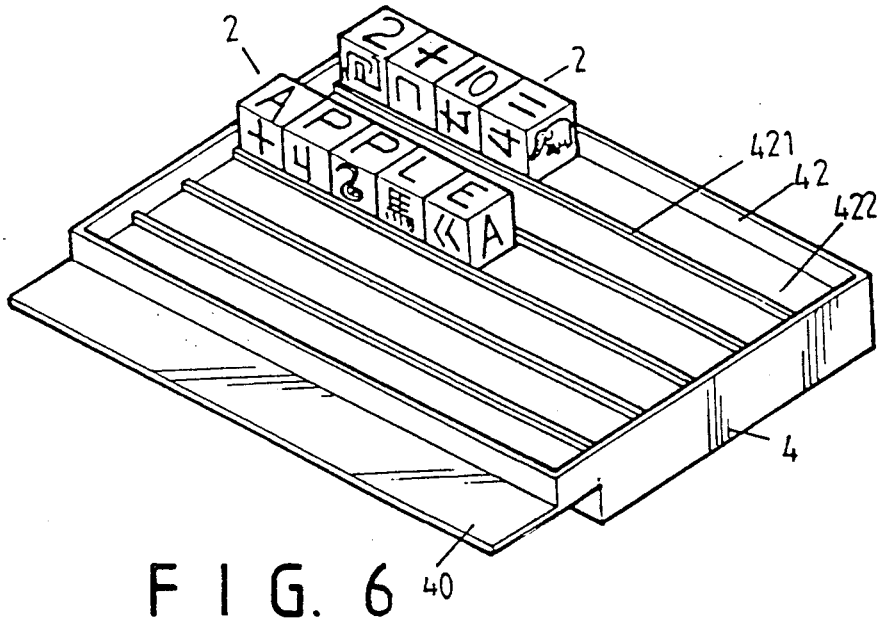

2. Mathematics practice:

As shown in FIG. 6, the numeral surfaces 22 of the blocks 2 may be arranged in the groove 422 of the upper surface 42 of the tray 4 thereby enabling the parents to teach mathematics to the children.

3. Spelling practice:

As shown in FIG. 6, the parents may teach the children to spell correctly by arranging the letter of the blocks 2 in the groove 422 of the upper surface 42 of the tray 4.

Figure 7A:
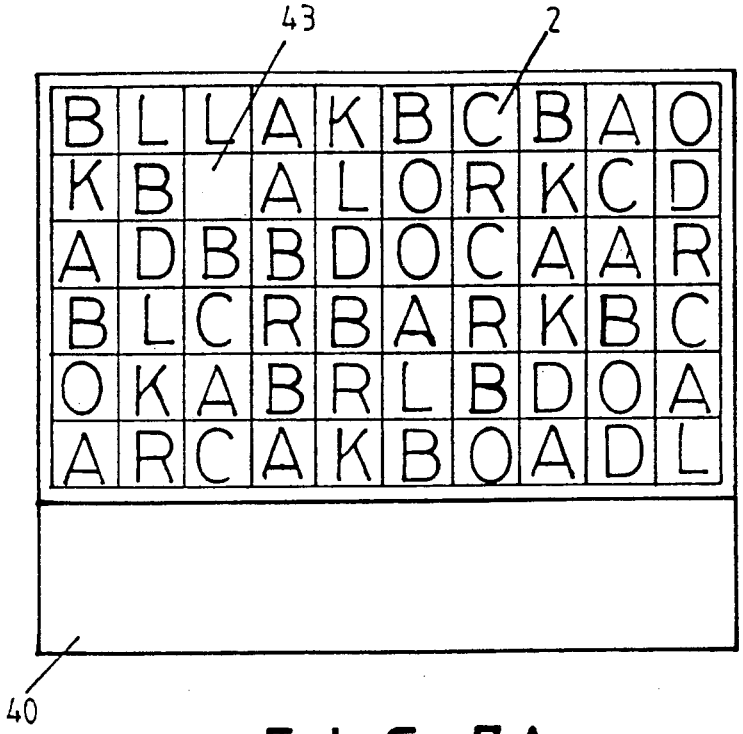
Figure 7B:
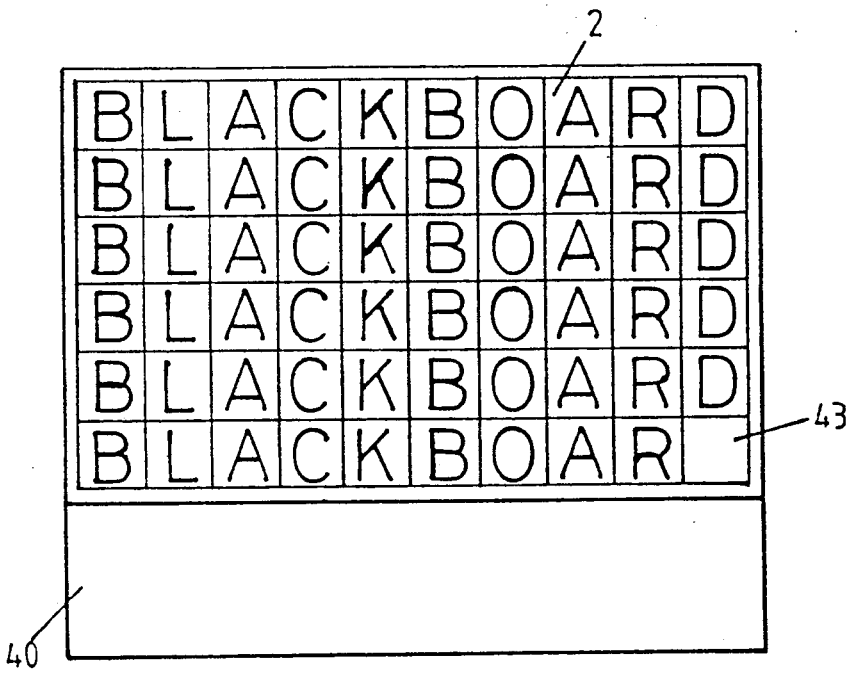

4. As shown in FIGS. 7A and 7B, the blocks 2 may be moved to practice spelling and brain storming.

Figure 8:
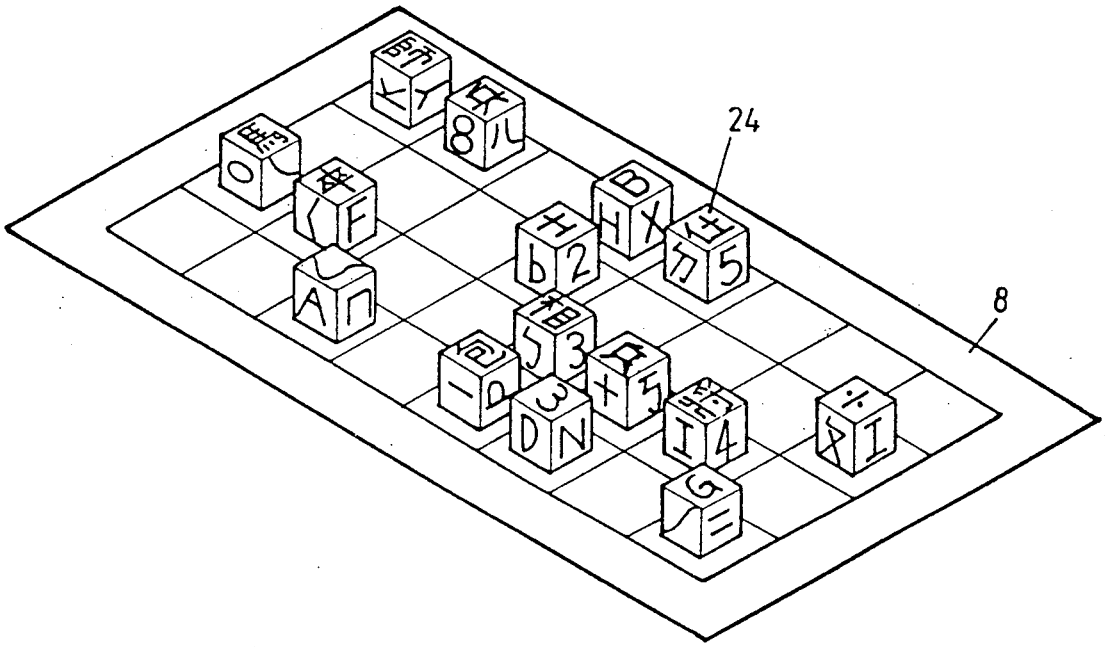
FIG. 8 shows the blocks in use with the chessboard.

5. As shown in FIG. 8, the chessman surfaces 25 of the blocks 2 may be used to play chess.

6. Building block:

The blocks 2 may be used as building blocks to make toy houses, etc.

7. Exercising book:

The children may use the pencil 5 (ball point pen) and crayon 6 in the minor chamber 113 of the case 1 to practice writing.

8. Game card:

The dice 3 :n the minor chamber 113 of the case 1 may be used in games of chance.

Although the present invention has been described with a certain degree of particularity, it is understood that the present disclosure :s made by way of example only and that numerous changes in the detail of construction and the combination and arrangement of parts may be resorted to without departing from the spirit and scope of the invention as hereinafter claimed.

I claim:

1. A block game for children comprising:

a case having a cover and a container divided into a major chamber and a minor chamber;

a plurality of blocks disposed in the major chamber of said case, each block having six surfaces with different patterns;

a tray adapted to be received in the major chamber of said case and having a flap adapted to cover the minor chamber of said case, said tray being divided into a plurality of grooves in an upper surface and a flat surface at a bottom thereof;

a pencil placed in the minor chamber of said case;

a crayon put in the minor chamber of said case;

an exercising book disposed on the upper surface of said tray; and a chess board put on the cover of said case.

* * * * *